US011595752B2

(12) United States Patent
Tsuchihashi et al.

(10) Patent No.: US 11,595,752 B2
(45) Date of Patent: Feb. 28, 2023

(54) ELECTROACOUSTIC TRANSDUCER

(71) Applicant: Yamaha Corporation, Hamamatsu (JP)

(72) Inventors: Yu Tsuchihashi, Hamamatsu (JP); Tomoya Miyata, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/333,881

(22) Filed: May 28, 2021

(65) Prior Publication Data

US 2021/0289288 A1 Sep. 16, 2021

Related U.S. Application Data

(63) Continuation of application No. PCT/JP2019/044725, filed on Nov. 14, 2019.

(30) Foreign Application Priority Data

Nov. 29, 2018 (JP) ..... JP2018-223180

(51) Int. Cl.
*H04R 1/28* (2006.01)

(52) U.S. Cl.
CPC ..... *H04R 1/28* (2013.01)

(58) Field of Classification Search
CPC ..... H04R 1/28
See application file for complete search history.

(56) References Cited

U.S. PATENT DOCUMENTS 5,471,019 A * 11/1995 Maire ..... H04R 1/2842 181/156
2002/0061114 A1* 5/2002 Croft, III ..... H04R 1/2842 381/345
2013/0266151 A1 10/2013 Kishinami et al.
2013/0315431 A1 11/2013 Grinker et al.
2015/0092968 A1 4/2015 Grinker et al.
2018/0160248 A1* 6/2018 Murakami ..... H04R 31/003
2018/0249255 A1* 8/2018 Ishii ..... H04R 7/04

FOREIGN PATENT DOCUMENTS

JP 2015-521007 A 7/2015
JP 2018-7220 A 1/2018
KR 10-1539064 B1 7/2015
(Continued)

OTHER PUBLICATIONS

International Search Report (PCT/ISA/210) issued in PCT Application No. PCT/JP2019/044725 dated Jan. 28, 2020 with English translation (five (5) pages).
(Continued)

*Primary Examiner* — Andrew L Sniezek
(74) *Attorney, Agent, or Firm* — Crowell & Moring LLP

(57) ABSTRACT

An electroacoustic transducer includes a housing, one or more partition walls, a diaphragm, and a tube. The one or more partition walls divide an inner space of the housing into a plurality of spaces, such that a volume of a first of the plurality of spaces is different from a volume of a second of the plurality of spaces except the first of the plurality of spaces. The diaphragm is disposed in the housing, such that one surface thereof faces the plurality of spaces. The tube establishes communication between a sound wave emission opening that is open to an outer space of the housing and each of the plurality of spaces.

15 Claims, 7 Drawing Sheets

(56) References Cited

FOREIGN PATENT DOCUMENTS

| | | | |
|---|---|---|---|
| WO | WO 2012/090433 | A1 | 7/2012 |
| WO | WO 2016/171250 | A1 | 10/2016 |

OTHER PUBLICATIONS

International Preliminary Report on Patentability (PCT/IB/338 & PCT/IB/373) issued in PCT Application No. PCT/JP2019/044725 dated Jun. 10, 2021, including Japanese-language Written Opinion (PCT/ISA/237) with English translation (13 pages).

Japanese-language Office Action issued in Japanese Application No. 2018-223180 dated Aug. 4, 2022 with English translation (eight (8) pages).

* cited by examiner

ELECTROACOUSTIC TRANSDUCER

CROSS REFERENCE TO RELATED APPLICATION

The present application is a continuation application of International Application No. PCT/JP2019/044725, filed on Nov. 14, 2019, which claims priority to Japanese Patent Application No. 2018-223180, which was filed on Nov. 29, 2018. The contents of these applications are incorporated by reference in their entirety.

BACKGROUND

The following disclosure relates to an electroacoustic transducer such as a speaker, an earphone, and headphones.

An existing electroacoustic transducer includes a diaphragm that vibrates in accordance with an externally applied sound signal (an electric signal representing a sound waveform) to output a sound wave based on the sound signal. For instance, there is an earphone that includes an electromagnetic tweeter including a piezoelectric element as the diaphragm and a dynamic woofer. In the conventional earphone, sounds output from the tweeter and sounds output from the woofer are output from the same sound emitting portion.

SUMMARY

In the conventional earphone including driver units of a plurality of different types mainly corresponding to mutually different frequency ranges, it is difficult to obtain acoustic characteristics that are constant from a low-frequency range to a high-frequency range. Specifically, the vibration characteristics unique to the respective driver units are different among the driver units, causing unnaturalness in the crossover frequency range in which the frequency ranges, for which the respective driver units are responsible, cross one another. For instance, in a case where the driver unit for the low-frequency range and the driver unit for the high-frequency range are different in material, sound reverberation in the low-frequency range and sound reverberation in the high-frequency range may not match with each other.

Accordingly, one aspect of the present disclosure is directed to a technique of achieving constant acoustic characteristics from a low-frequency range to a high-frequency arrange in an electroacoustic transducer configured to output a sound wave based on an externally applied sound signal.

In one aspect of the present disclosure, an electroacoustic transducer includes: a housing; one or more partition walls that divide an inner space of the housing into a plurality of spaces such that a volume of a first of the plurality of spaces is different from a volume of a second of the plurality of spaces except the first of the plurality of spaces; a diaphragm disposed in the housing such that one surface thereof faces the plurality of spaces; and a tube that establishes communication between a sound wave emission opening that is open to an outer space of the housing and each of the plurality of spaces.

The objects, features, advantages, and technical and industrial significance of the present disclosure will be better understood by reading the following detailed description of embodiments, when considered in connection with the accompanying drawings, in which:

DETAILED DESCRIPTION

Figure 1:
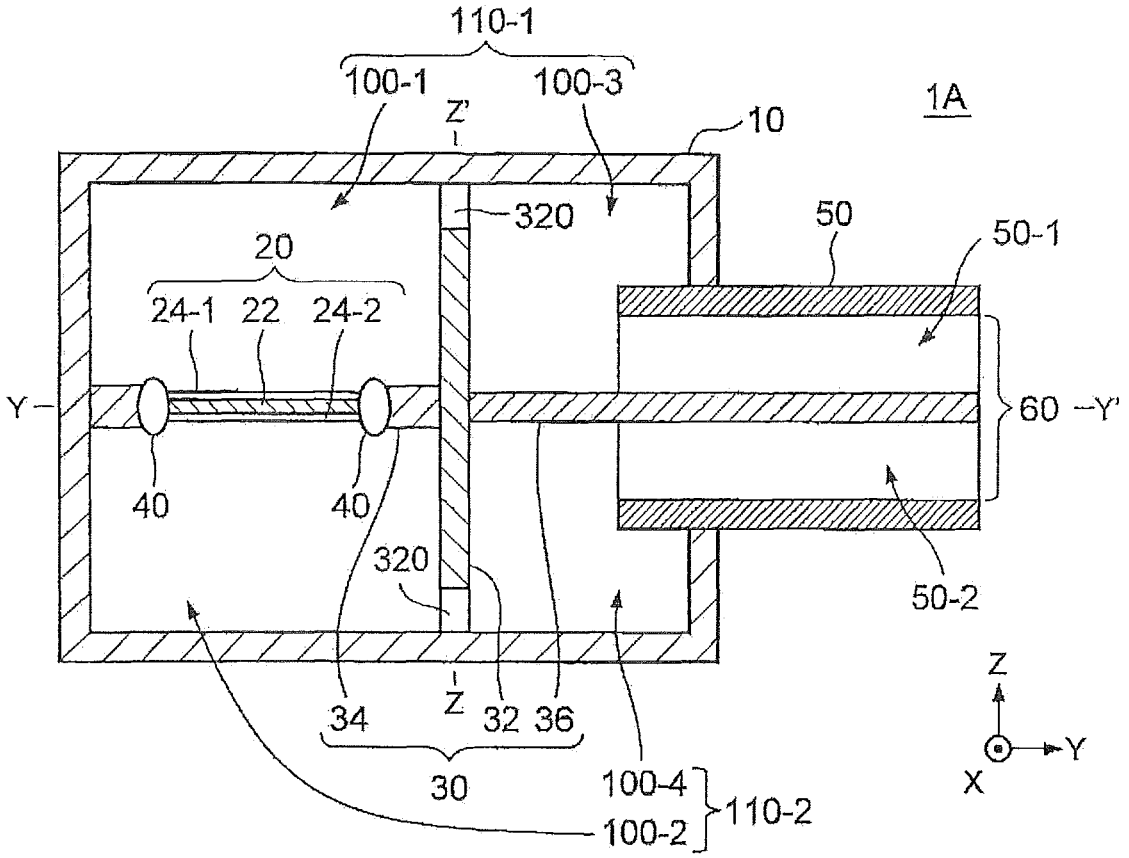
FIG. 1 is a cross-sectional view of an inventive earphone.
Figure 2:
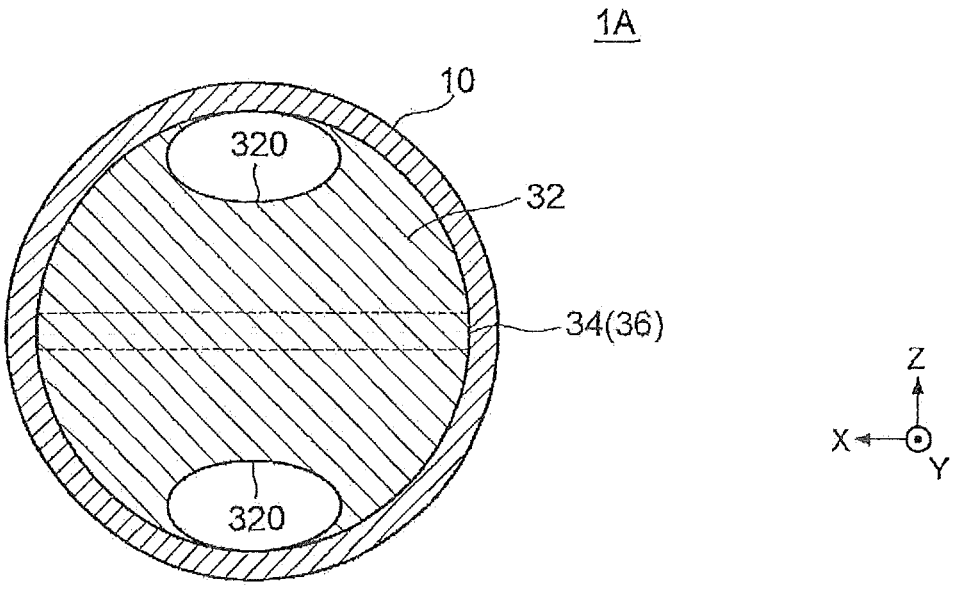
FIG. 2 is a cross-sectional view of the earphone of FIG. 1.
Figure 3:
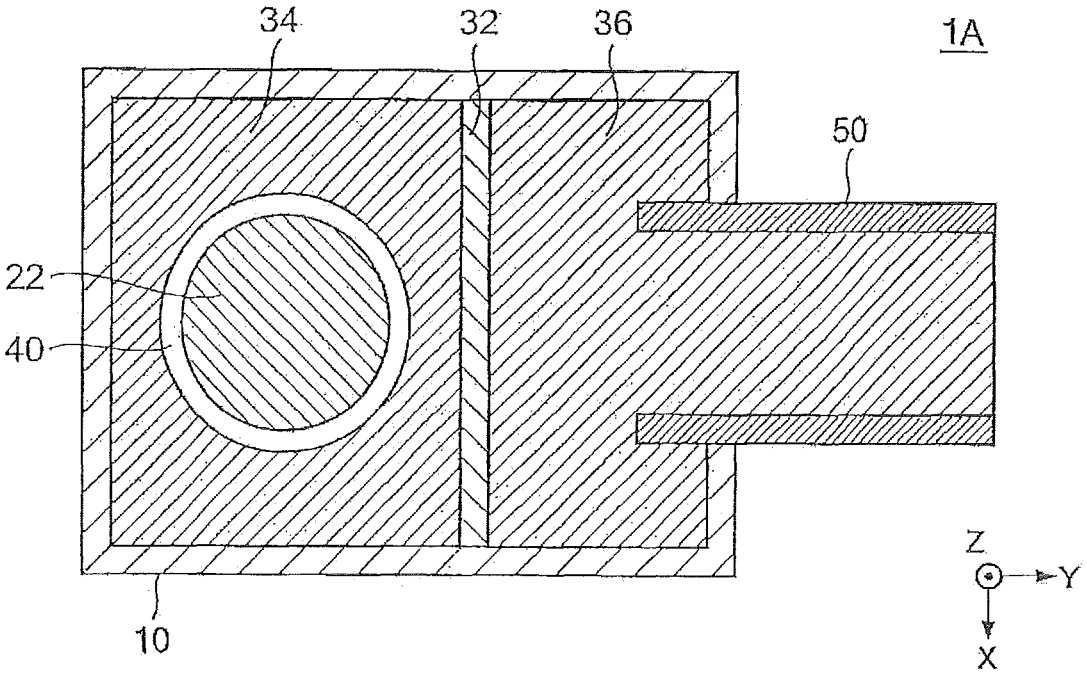
FIG. 3 is a cross-sectional view of the earphone of FIG. 1.

Referring to the drawings, there will be hereinafter described embodiments of the present disclosure. FIGS. 1-3 are cross-sectional views of an earphone 1A, as one example of an electroacoustic transducer, according to an embodiment of the present disclosure. FIG. 2 is a cross-sectional view taken along a plane along line Z-Z' in FIG. 1. FIG. 3 is a cross-sectional view taken along a plane along line Y-Y' in FIG. 1. As illustrated in FIGS. 1-3, the earphone 1A includes a housing 10, a diaphragm 20, a partition wall 30, and a tube 50.

The housing 10 is a hollow cylindrical member formed of resin. A through-hole, to which the tube 50 is mounted, is formed in one of two circular end faces of the housing 10. The tube 50 connects the housing 10 and an earpiece to be inserted into an earhole of a user. Like the housing 10, the tube 50 is formed of resin. In FIG. 1 and other drawings, illustration of the earpiece is omitted.

The diaphragm 20 is a piezoelectric element that vibrates in accordance with an externally applied sound signal. As illustrated in FIGS. 1 and 3, the diaphragm 20 is shaped like a flat disk having a diameter smaller than an inside diameter of the housing 10. As illustrated in FIG. 1, the diaphragm 20 includes a porous film 22 and a pair of electrodes 24-1, 24-2 sandwiching the porous film 22 therebetween. In the following description, a direction from one of the two electrodes 24-1, 24-2 toward the other of the two electrodes 24-1, 24-2 will be referred to as a thickness direction of the porous film 22. In FIGS. 1-3, a Z direction corresponds to the thickness direction of the porous film 22. The diaphragm 20 may have any planar shape, namely, may have any shape viewed in the Z direction, other than a circle. That is, the planar shape of the diaphragm 20 may be an ellipse or a polygon such as a quadrangle or a pentagon.

The porous film 22 is formed of a piezoelectric material. One of the electrodes 24-1, 24-2 is grounded. To the other of the electrodes 24-1, 24-2, a voltage based on the sound signal is applied. The porous film 22 expands or contracts in the thickness direction based on the voltage applied between the electrodes 24-1, 24-2. Specifically, based on the voltage applied between the electrodes 24-1, 24-2, a portion of the porous film 22 sandwiched between the electrodes 24-1, 24-2 expands in mutually opposite directions from the center of the porous film 22 in the thickness direction toward the respective electrodes 24-1, 24-2 or contracts in mutually opposite directions from the respective electrodes 24-1, 24-2 toward the center in the thickness direction. With this configuration, the diaphragm 20 vibrates, and sound waves are emitted to spaces located outside the respective electrodes 24-1, 24-2.

The piezoelectric material of which the porous film 22 is formed has piezoelectric characteristics given as follows. For instance, a multiplicity of flat pores are formed in polytetrafluoroethylene (PTFE), polypropylene (PP), polyethylene(PE), polyethylene terephthalate (PET) or the like, and opposed faces of the flat pores are polarized and electrified by a corona discharge or the like. A lower limit of an average thickness of the porous film 22 is preferably 10 μm and more preferably 50 μm. An upper limit of the average thickness of the porous film 22 is preferably 500 μm and more preferably 200 μm. When the average thickness of the porous film 22 is less than the lower limit, the strength of the porous film 22 may be insufficient. When the average thickness of the porous film 22 is greater than the upper limit, the deformation amount of the porous film 22 may decrease, resulting in an insufficient output sound pressure.

The electrodes 24-1, 24-2 are laminated respectively on opposite surfaces of the porous film 22. When it is not necessary to distinguish the electrode 24-1 and the electrode 24-2 from each other, each of them will be referred to as "electrode 24". The electrode 24 may be formed of any conductive material examples of which include: metals such as aluminum, copper, and nickel: and a carbon. An average thickness of the electrode 24, which may vary depending on a laminating process, is not smaller than 0.1 μm and not greater than 30 μm, for instance. When the average thickness of the electrode 24 is less than the lower limit, the strength of the electrode 24 may be insufficient. When the average thickness of the electrode 24 is greater than the upper limit, the vibration of the porous film 22 may be inhibited. The electrodes 24 may be laminated on the porous film 22 by any suitable method such as vapor deposition of a metal, printing with a conductive carbon ink, and application and drying of a silver paste.

As illustrated in FIG. 1, the partition wall 30 includes a first member 32, a second member 34, and a third member 36. As illustrated in FIG. 2, the first member 32 is shaped like a flat disk whose diameter is equal to the inside diameter of the housing 10. As illustrated in FIG. 3, the second member 34 is shaped like a rectangular plate whose length in an X direction is equal to the inside diameter of the housing 10. The third member 36 is shaped like a plate having a planar shape illustrated in FIG. 3. Like the housing 10, the first member 32, the second member 34, and the third member 36 are formed of resin.

As illustrated in FIG. 2, the first member 32 has two elliptical cutouts 320 formed at its diametrically opposite ends. As illustrated in FIGS. 1-3, the second member 34 is bonded by an adhesive or the like to one of two generally circular surfaces of the first member 32 at a middle position thereof in a direction from one of the two cutouts 320 toward the other of the two cutouts 320, i.e., in the Z direction, such that the second member 34 extends so as to be orthogonal to the Z direction. The third member 36 is bonded by an adhesive or the like to the other of the two generally circular surfaces of the first member 32 at a middle position thereof in the Z direction, such that the third member 36 extends so as to be orthogonal to the Z direction. In the present embodiment, the partition wall 30 is constituted by the three separate members, i.e., the first member 32, the second member 34, and the third member 36. The partition wall 30 may be formed by integral molding of all of or a part of these three members.

The second member 34 has a through-hole to which the diaphragm 20 is mounted. As illustrated in FIGS. 1 and 3, the diaphragm 20 is mounted to the through-hole of the second member 34 via a ring-like elastic member 40. The diaphragm 20 is mounted to the through-hole of the second member 34 via the elastic member 40 for preventing the vibration of the diaphragm 20 in the thickness direction from being inhibited. As illustrated in FIGS. 1 and 3, the diaphragm 20 is disposed in the housing 10 in a state in which the diaphragm 20 is attached to the partition wall 30, more strictly, in a state in which the diaphragm 20 is attached to the second member 34 of the partition wall 30.

An inner space of the housing 10 (a space of the housing 10 closer to the diaphragm 20) is divided into four spaces 100-1, 100-2, 100-3, 100-4 by the partition wall 30 to which the diaphragm 20 is attached. The space 100-2 and the space 100-4 are in communication with each other through the one of the two cutouts 320. In the following description, a space provided by the spaces 100-1, 100-3 that are in communication with each other through the other of the two cutouts 320 will be referred to as a first space 110-1, and a space provided by the spaces 100-2, 100-4 that are in communication with each other through the one of the two cutouts 320 will be referred to as a second space 110-2. In the present embodiment, the first space 110-1 and the second space 110-2 are substantially identical in shape and volume. That is, as illustrated in FIG. 1, the partition wall 30 divides the inner space of the housing 10 into the first space 110-1 closer to one of the two electrodes of the diaphragm 20, i.e., the electrode 24-1, and the second space 110-2 closer to the other of the two electrodes, i.e., the electrode 24-2.

As illustrated in FIG. 1, the tube 50 is divided, by the third member 36 of the partition wall 30, into two tubes, i.e., a first tube 50-1 and a second tube 50-2, that have substantially the same tube length and substantially the same cross-sectional area. The first tube 50-1 establishes communication between a sound wave emission opening 60 that is open to an outer space of the housing 10 and the first space 110-1. The second tube 50-2 establishes communication between the sound wave emission opening 60 and the second space 110-2.

In the earphone 1A of the present embodiment, one of the two electrodes 24-1, 24-2 is grounded. When a voltage based on the sound signal is applied to the other of the two electrodes 24-1, 24-2, the diaphragm 20 vibrates and sound waves in the same phase based on the sound signal are emitted respectively from one of the opposite surfaces of the diaphragm 20 that is located on a side of the electrode 24-1 and the other of the opposite surfaces of the diaphragm 20 that is located on a side of the electrode 24-2. The sound wave emitted from the one surface of the diaphragm 20 located on the side of the electrode 24-1 is emitted through the sound wave emission opening 60 to the outer space of the housing 10 via the first space 110-1 and the first tube 50-1. The sound wave emitted from the other surface of the diaphragm 20 located on the side of the electrode 24-2 is emitted through the sound wave emission opening 60 to the outer space of the housing 10 via the second space 110-2 and the second tube 50-2.

The sound waves respectively emitted from the one surface of the diaphragm 20 located on the side of the electrode 24-1 and the other surface of the diaphragm 20 located on the side of the electrode 24-2 are in the same phase, and acoustic spaces to which the respective sound waves propagate have substantially the same shape. Thus, frequency characteristics of sounds that are emitted from one of the opposite surfaces of the diaphragm 20 to reach the ear of the user are identical to frequency characteristics of sounds that are emitted from the other of the opposite surfaces of the diaphragm 20 to reach the ear of the user. For instance, if the frequency characteristics of the former are flat frequency characteristics not including peaks and dips, the frequency characteristics of the latter are also flat. In the earphone 1A of the present embodiment, the sounds emitted from both surfaces of the diaphragm 20 are superposed on one another at the sound wave emission opening 60, so that the earphone 1A of the present embodiment can obtain characteristics in which the output (sound volume) is doubled, as compared with conventional earphones that utilize only sounds emitted from its one surface.

As explained above, the earphone 1A of the present embodiment effectively utilize the sound waves respectively emitted from both surfaces of the diaphragm 20 so as to attain doubled output, as compared with the conventional earphones that utilize only the sounds emitted from its one surface.

Figure 4:
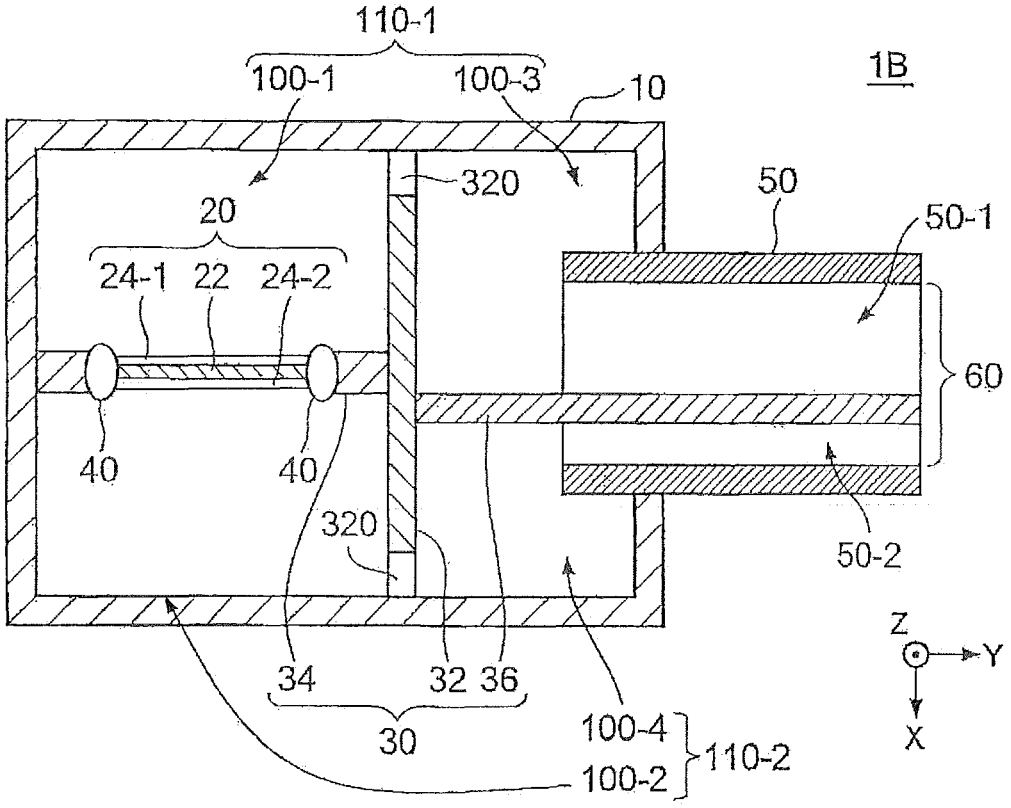
FIG. 4 is a cross-sectional view of an inventive earphone.
Figure 5:
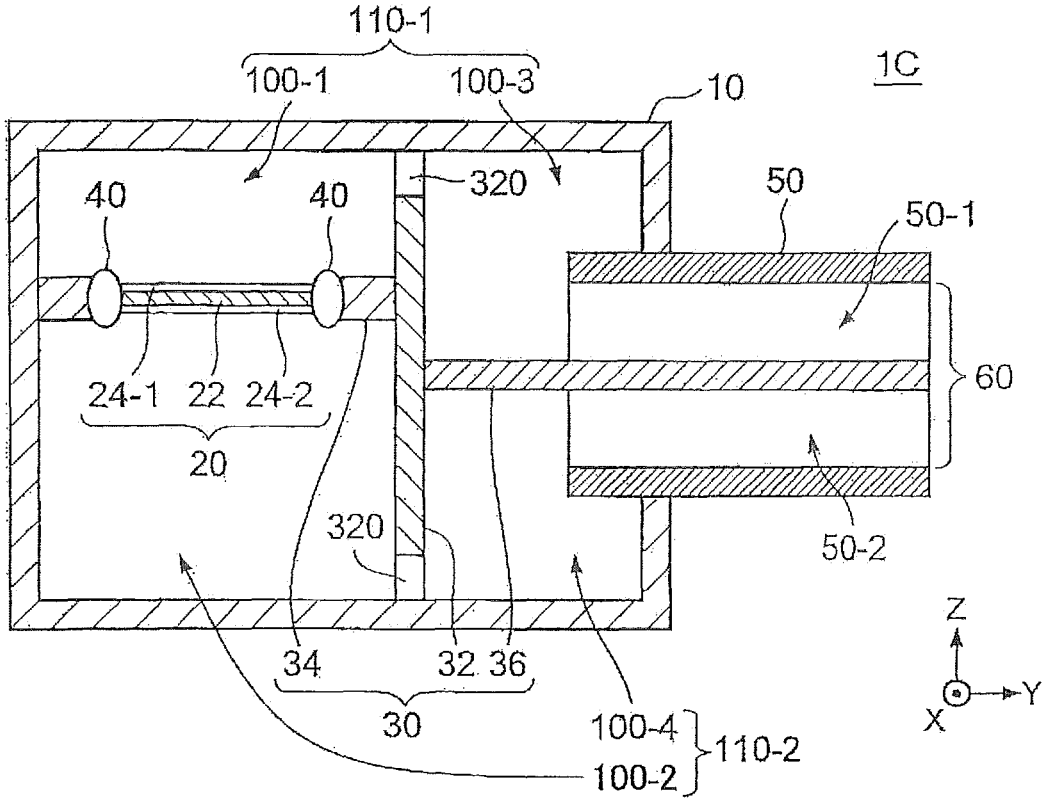
FIG. 5 is a cross-sectional view of an inventive earphone.

FIGS. 4 and 5 are cross-sectional views respectively illustrating an earphone 1B and an earphone 1C according to an embodiment of the present disclosure. The same reference signs as used in FIG. 1 are used to identify the corresponding constituent elements in FIGS. 4 and 5. In each of the earphones 1B, 1C of the present embodiment, two acoustic spaces, to which the sound waves respectively emitted from one and the other of the opposite surfaces of the diaphragm 20 propagate, are different in shape. The earphone 1B of the present embodiment differs from the earphone 1A of the previous embodiment in this aspect.

In the earphone 1B illustrated in FIG. 4, the third member 36 is disposed so as to be shifted in the Z direction such that the cross-sectional area of the second tube 50-2 is smaller than the cross-sectional area of the first tube 50-1. In the earphone 1C illustrated in FIG. 5, the cross-sectional area of the first tube 50-1 and the cross-sectional area of the second tube 50-2 are equal to each other. In the earphone 1C, however, the second member 34 is disposed so as to be shifted in the Z direction such that the volume of the space 100-1 is smaller than the volume of the space 100-2, in other words, such that the volume of the first space 110-1 is smaller than the volume of the second space 110-2. The two acoustic spaces, to which the sound waves respectively emitted from one and the other of the opposite surfaces of the diaphragm 20 propagate, have mutually different shapes for the following reasons.

Some adjustment such as emphasis of high- and low-frequency ranges is often needed in the earphone depending on the sound signal based on which sounds are to be reproduced, tastes or preferences of the user, etc. In the configuration illustrated in FIG. 4, reflection of sounds in the high-frequency range is small in the first tube 50-1 whose cross-sectional area is enlarged, thus enabling emission of sounds in which characteristics of the high-frequency range are emphasized. In the second tube 50-2 whose cross-sectional area is reduced, on the other hand, reflection of sounds in the high-frequency range is strong, and sounds in the low-frequency range are relatively allowed to pass. As a result, sounds in the mid-frequency range are relatively lowered at the sound wave emission opening 60 of the earphone 1B, as compared with the earphone 1A of the previous embodiment, thus achieving characteristics in which the low-frequency range and the high-frequency range are emphasized. It is noted that the cross-sectional area of one of the first tube 50-1 and the second tube 50-2 may remain the same as the cross-sectional area thereof in the previous embodiment while the cross-sectional area of the other of the first tube 50-1 and the second tube 50-2 may be changed, whereby only the low-frequency range or only the high-frequency range may be emphasized.

In the earphone 1B illustrated in FIG. 4, the high-frequency range and the low-frequency range are emphasized by adjusting the cross-sectional area of the first tube 50-1 and the cross-sectional area of the second tube 50-2. In the earphone 1C illustrated in FIG. 5, the volume of the first space 110-1 and the volume of the second space 110-2 are adjusted to adjust the sound quality similarly. The reasons are as follows.

In the earphone 1A of the previous embodiment, there is generated Helmholtz resonance (hereinafter referred to as "first Helmholtz resonance") in which the first space 110-1 serves as a cavity and the first tube 50-1 serves as a neck, and there is generated Helmholtz resonance (hereinafter referred to as "second Helmholtz resonance") in which the second space 110-2 serves as a cavity and the second tube 50-2 serves as a neck. As described above, in the earphone 1A of the previous embodiment, the volume of the first space 110-1 and the volume of the second space 110-2 are substantially equal to each other, and the cross-sectional area of the first tube 50-1 and the cross-sectional area of the second tube 50-2 are substantially equal to each other. Thus, the resonance frequency of the first Helmholtz resonance and the resonance frequency of the second Helmholtz resonance in the earphone 1A of the previous embodiment are substantially equal to each other. When the volume of each of the first space 110-1 and the second space 110-2 is represented as V and the cross-sectional area of each of the first tube 50-1 and the second tube 50-2 is represented as S, the resonance frequency $f_0$ of the first Helmholtz resonance and the second Helmholtz resonance is represented by the following expression (1). In the expression (1), 1 represents a length of the neck, c represents a sound speed, and δ represents an open end correction value. When the diameter of the opening of the neck is d, δ is approximately equal to 0.8×d, i.e., δ≈0.8×d.

$$f_0 = \frac{c}{2\pi}\sqrt{\frac{s}{V(l+\delta)}} \tag{1}$$

Also in the earphone 1C of FIG. 5, the first Helmholtz resonance and the second Helmholtz resonance are generated. In the earphone 1C of FIG. 5, the volume of the first space 110-1 is smaller than the volume of the first space 110-1 in the earphone 1A of FIG. 1. Thus, the resonance frequency of the first Helmholtz resonance in the earphone 1C is shifted to a higher frequency side than the resonance frequency $f_0$ in the previous embodiment. In the earphone 1C of FIG. 5, the volume of the second space 110-2 is larger than the volume of the second space 110-2 in the earphone 1A. Thus, the resonance frequency of the second Helmholtz resonance in the earphone 1C is shifted to a lower frequency side than the resonance frequency $f_0$ in the previous embodiment. Like the earphone 1B, the earphone 1C of FIG. 5 also achieves the characteristics in which the low-frequency range and the high-frequency range are emphasized.

As explained above, the present embodiment enables the sound-quality adjustment in specific frequency ranges while effectively utilizing the sound waves emitted from both surfaces of the diaphragm 20.

In addition, the earphones according to the present embodiment enjoy constant acoustic characteristics over a wide frequency range from low frequencies to high frequencies. Conventional earphones sometimes include driver units of different types provided for different frequency ranges. In this case, the vibration characteristics unique to the respective driver units are different among the driver units, causing unnaturalness in the crossover frequency range. For instance, in a case where the driver unit for the low-frequency range and the driver unit for the high-frequency range are different in material, sound reverberation in the low-frequency range and sound reverberation in the high-frequency range may not match with each other. In contrast, the earphones according to the present embodiment do not include driver units of different types used for different frequency ranges, thus achieving constant acoustic characteristics over a wide frequency range from low frequencies to high frequencies. Further, because the earphones according to the present embodiment do not include driver units of different types used for different frequency ranges, resulting in cost and size reductions.

Figure 6:
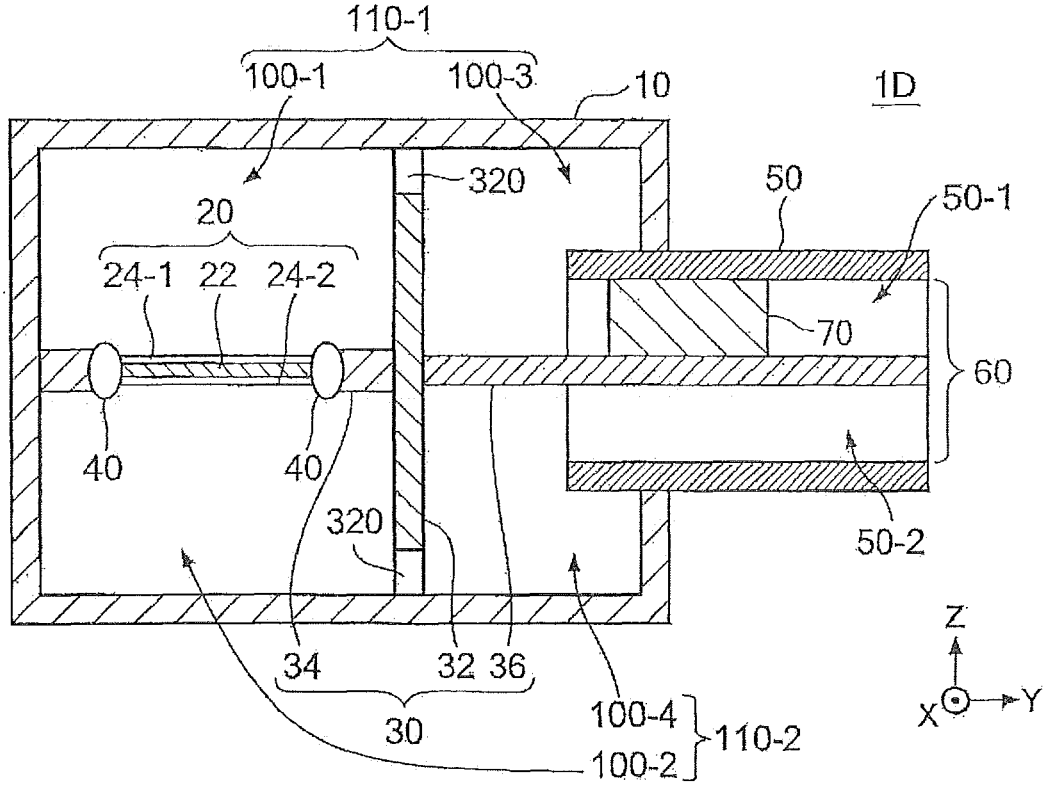
FIG. 6 is a cross-sectional view of an inventive earphone.
Figure 7:
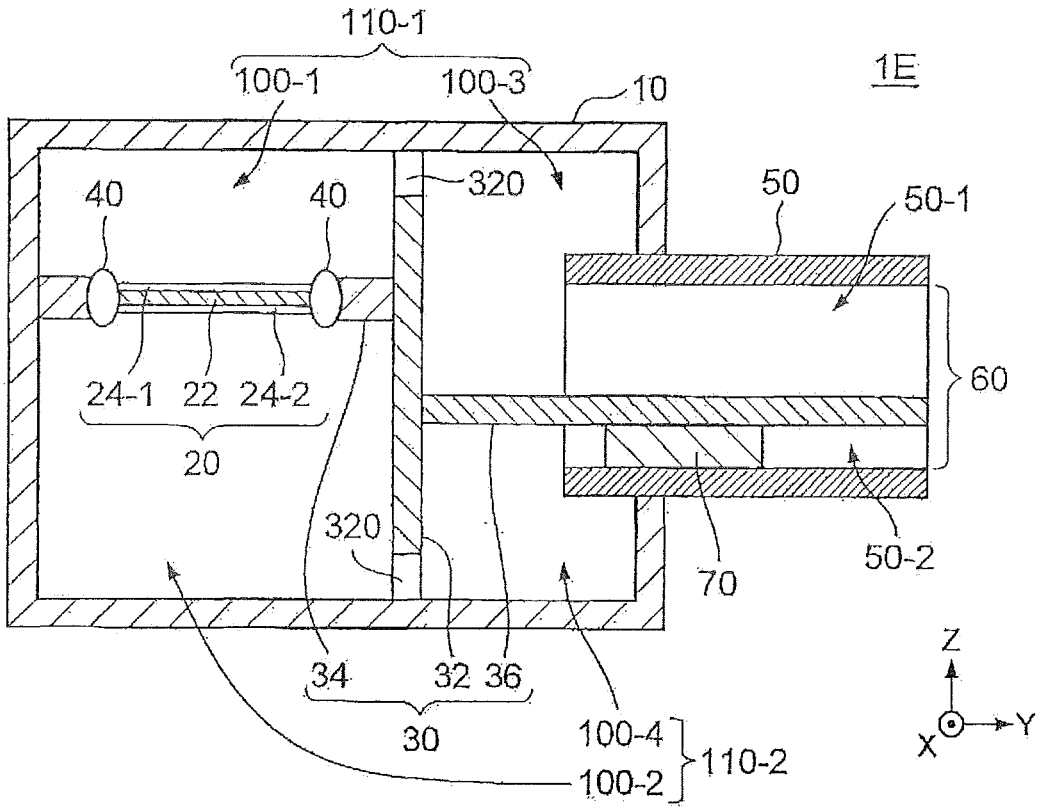
FIG. 7 is a cross-sectional view of an inventive earphone.

FIGS. 6 and 7 are cross-sectional views respectively illustrating an earphone 1D and an earphone 1E according to an embodiment of the present disclosure. The same reference signs as used in FIG. 1 are used to identify the corresponding constituent elements in FIGS. 6 and 7. As apparent from a comparison between FIG. 1 and FIG. 6, the earphone 1D illustrated in FIG. 6 differs from the earphone 1A of the previous embodiment in that a sound absorber 70 formed of a nonwoven fabric or the like is packed in the first tube 50-1. Further, as apparent from a comparison between FIG. 7 and FIG. 5, the earphone 1E illustrated in FIG. 7 differs from the earphone 1C of the previous embodiment in that i) the cross-sectional area of the second tube 50-2 is smaller than the cross-sectional area of the first tube 50-1 and ii) the sound absorber 70 is packed in the second tube 50-2.

Packing the sound absorber in the tube 50 is equivalent to reducing the cross-sectional area of the tube 50. According to the present embodiment, the fine adjustment of the sound-quality in specific frequency ranges can be easily performed by packing the sound absorber in any one of the first tube 50-1 and the second tube 50-2. Also in the present embodiment, the sound waves emitted from both surfaces of the diaphragm 20 can be effectively utilized as in the previous embodiment. Further, the earphones of the present embodiment do not include driver units of different types used for different frequency ranges, thus achieving constant acoustic characteristics over a wide frequency range from low frequencies to high frequencies and resulting in cost and size reductions, as in the previous embodiment. In the present embodiment, the sound absorber 70 is packed in one of the first tube 50-1 and the second tube 50-2. The sound absorber 70 may be packed in both the first tube 50-1 and the second tube 50-2.

FIGS. 8-11 are cross-sectional views respectively illustrating an earphone 1F, an earphone 1G, an earphone 1H, and an earphone 11 according to an embodiment of the present disclosure. The earphone 1F illustrated in FIG. 8 differs from the earphone 1A of the previous embodiment in the following three aspects. The first different aspect is that the earphone 1F includes a partition wall 30' in place of the partition wall 30. As apparent from a comparison between FIG. 8 and FIG. 5, the partition wall 30' differs from the partition wall 30 in that i) the partition wall 30' does not have the through-hole to which the diaphragm 20 is mounted and ii) the partition wall 30' has a generally L-shaped cross section. In the earphone 1F of the present embodiment, the inner space of the housing 10 is divided by the partition wall 30' into the space 100-1 and the space 100-2 whose volume is smaller than that of the space 100-1.

Figure 8:
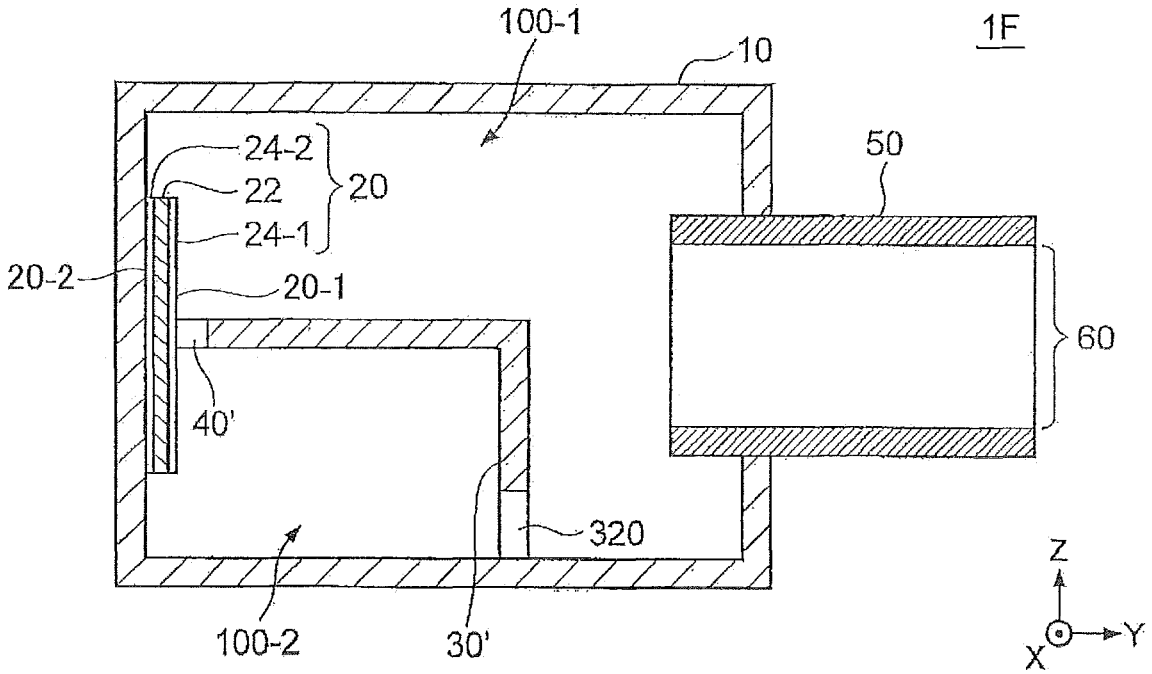
FIG. 8 is a cross-sectional view of an inventive earphone.

The second different aspect is that the diaphragm 20 is disposed such that one surface of the diaphragm 20, namely, one surface thereof located on the side of the electrode 24-1, faces the space 100-1 and the space 100-2. As illustrated in FIG. 8, the diaphragm 20 shaped like a plate has opposite surfaces in its thickness direction. One of the opposite surfaces of the diaphragm 20, namely, one surface 20-1 (as one example of a first surface), is exposed to the inner space of the housing 10, and the other of the opposite surfaces, namely, the other surface 20-2 (as one example of a second surface) opposite to the one surface 20-1, is fixed to an inner wall of the housing 10. In a case where the electrode 24-1 and 24-2 are respectively laminated on opposite surfaces of the porous film 22, a surface of the electrode 24-1 that is exposed to the inner space of the housing 10 is the one surface 20-1 while a surface of the electrode 24-2 that is fixed to the inner wall of the housing 10 is the other surface 20-2. An elastic member 40' in FIG. 8 is a member filling a gap between the diaphragm 20 and one end of the partition wall 30' without inhibiting the vibration of the diaphragm 20 in the thickness direction. That is, the elastic member 40' divides, as a part of the partition wall 30', the inner space of the housing 10 into the space 100-1 and the space 100-2. The third different aspect is that the tube 50 is not divided into the first tube 50-1 and the second tube 50-2. The tube 50 establishes communication between the space 100-1 and the sound wave emission opening 60 and communication between the space 100-2 and the sound wave emission opening 60.

As illustrated in FIG. 8, the partition wall 30' having the generally L-shaped cross-section has a cutout 320 formed at an end thereof in the generally L-shaped cross section, and the end at which the cutout 320 is formed is fixed to the inner wall of the housing 10. (This end is one example of a second end of the partition wall.) Further, an elastic member 40' is disposed at an end of the partition wall 30' in the generally L-shaped cross section so as to connect the end and the one surface 20-1 of the diaphragm 20. (This end is one example of a first end of the partition wall.) Thus, the elastic member 40' is a member filling the gap between the end of the partition wall 30' in the generally L-shaped cross section and the one surface 20-1 of the diaphragm 20.

As illustrated in FIG. 8, the elastic member 40' is connected to the one surface 20-1 of the diaphragm 20. Here, a portion of the one surface 20-1 to which the elastic member 40' is connected is defined as a connected portion. A region of the one surface 20-1 located above the connected portion in FIG. 8 (as one example of a first region) is exposed to the space 100-1 and is not exposed to the space 100-2. A region of the one surface 20-1 located below the connected portion in FIG. 8 (as one example of a second region) is exposed to the space 100-2 and is not exposed to the space 100-1. With this configuration, the elastic member 40' can divide, as a part of the partition wall 30', the inner space of the housing 10 into the space 100-1 and the space 100-2 without inhibiting the vibration of the diaphragm 20 in the thickness direction.

In the earphone 1F constructed as illustrated in FIG. 8, reflection of sounds in the high-frequency range is small in the space 100-1, thus enabling emission of sounds in which characteristics of the high-frequency range are emphasized. In the space 100-2, on the other hand, reflection of sounds in the high-frequency range is strong, and sounds in the low-frequency range are relatively allowed to pass. As a result, sounds in the mid-frequency range are relatively lowered at the sound wave emission opening 60 at which sounds in the low-frequency range and sounds in the high-frequency range are superposed, as compared with the earphone 1A of the previous embodiment, thus achieving the characteristics in which the low-frequency range and the high-frequency range are emphasized.

Helmholtz resonance is generated also in the earphone 1F of the present embodiment. In the earphone 1F, the first Helmholtz resonance is generated in which the space 100-1 serves as a cavity and the tube 50 serves as a neck, and the second Helmholtz resonance is generated in which the space 100-2 serves as a cavity and the tube 50 serves as a neck. As described above, in the earphone 1F, the volume of the space 100-1 is larger than the volume of the space 100-2, and the resonance frequency of the first Helmholtz resonance is lower than the resonance frequency of the second Helmholtz resonance. Thus, like the earphone 1C of the previous embodiment, the earphone 1F of the present embodiment enables the sound-quality adjustment in specific frequency ranges. In addition, the earphone 1F of the present embodiment does not include driver units of different types used for different frequency ranges, thus achieving constant acoustic characteristics over a wide frequency range from low frequencies to high frequencies and resulting in cost and size reductions.

Figure 9:
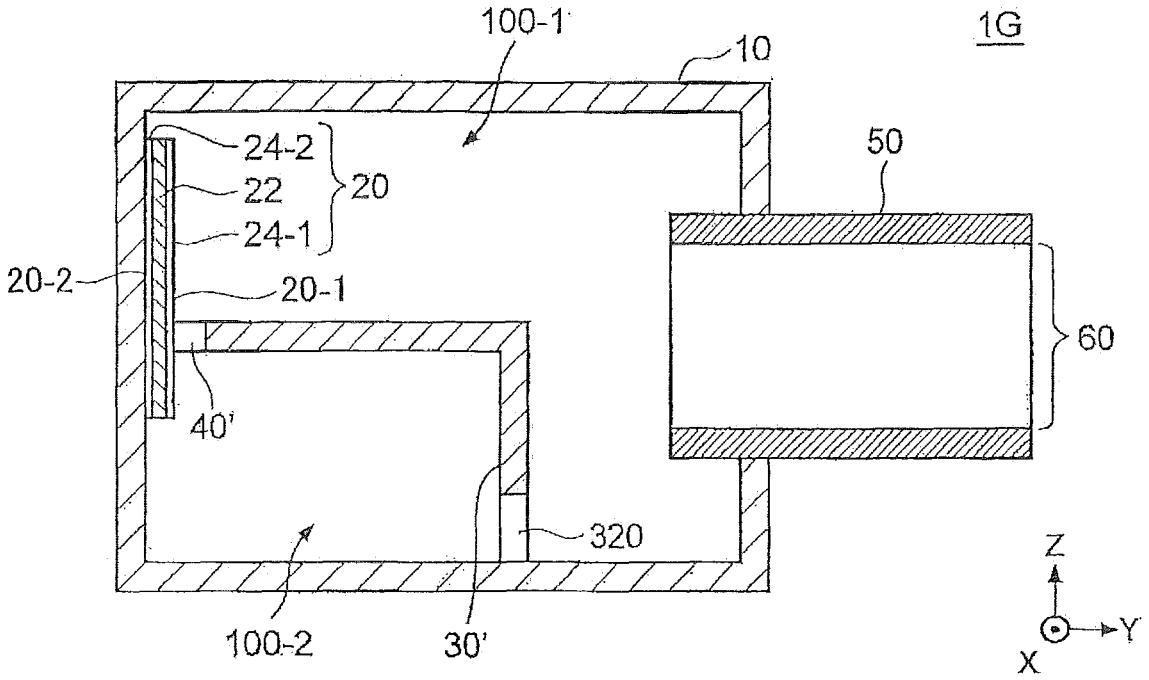
FIG. 9 is a cross-sectional view of an inventive earphone.

The earphone 1G illustrated in FIG. 9 differs from the earphone 1F in that the diaphragm 20 is disposed in the housing 10 so as to be shifted in the Z direction, such that a region of the diaphragm 20 facing the space 100-1 is larger than a region thereof facing the space 100-2. Like the earphone 1F, the earphone 1G of FIG. 9 enables the sound-quality adjustment in specific frequency ranges, achieves constant acoustic characteristics over a wide frequency range from low frequencies to high frequencies, and enjoys cost and size reductions.

Figure 10:
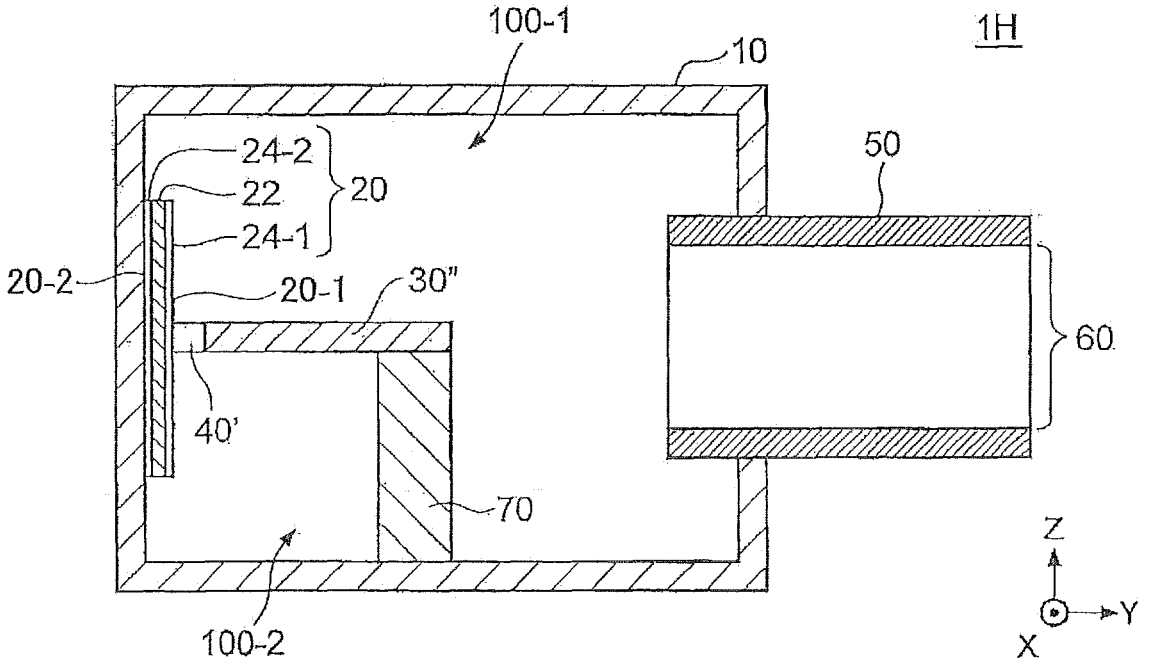
FIG. 10 is a cross-sectional view of an inventive earphone.
Figure 11:
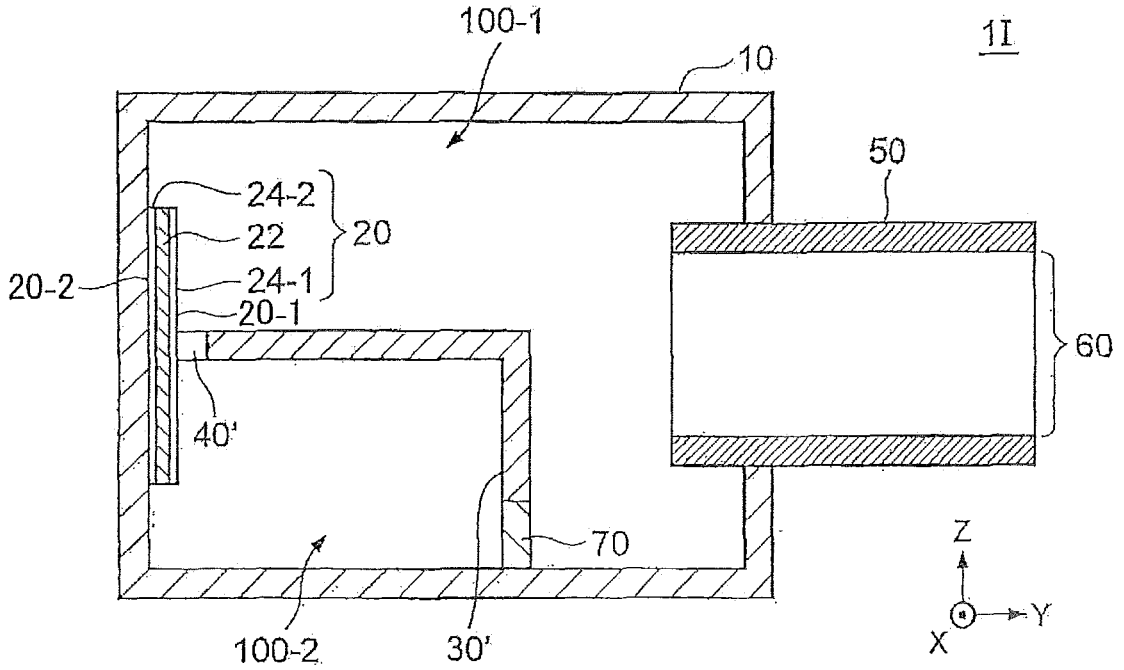
FIG. 11 is a cross-sectional view of an inventive earphone.

The earphone 1H illustrated in FIG. 10 differs from the earphone 1F in that the space 100-2 is defined by a partition wall 30" shaped like a plate and the sound absorber 70. The earphone 1I illustrated in FIG. 11 differs from the earphone 1F in that the space 100-2 is defined by the partition wall 30' and the sound absorber 70. The earphones IH, 1I also enable the sound-quality adjustment in specific frequency ranges, achieve constant acoustic characteristics over a wide frequency range from low frequencies to high frequencies, and enjoy cost and size reductions.

While the previous embodiments have been described above, the embodiments may be modified as follows.

(1) In the embodiments illustrated above, the present disclosure is applied to the earphones. The electroacoustic transducer to which the present disclosure is applicable is not limited to the earphones but may be headphone speakers.

(2) The diaphragm in the previous embodiment is not limited to the piezoelectric element that includes the porous film formed of the piezoelectric material described above. The piezoelectric element may be a piezoelectric element in which lead zirconate titanate (PZT) or the like is used as the piezoelectric material, namely, a piezoelectric element capable of outputting from only one surface thereof. The diaphragm may be driven by a voice coil.

(3) In the previous embodiment, the inner space of the housing is divided into two spaces by one partition wall. The inner space of the housing may be divided into three or more spaces by two or more partition walls. That is, the electroacoustic transducer includes the housing, one or a plurality of partition walls that divide the inner space of the housing into a plurality of spaces such that at least one of the plurality of spaces has a volume different from a volume of at least one of others of the plurality of spaces except the at least one of the plurality of spaces, the diaphragm disposed in the housing such that one surface thereof faces the plurality of spaces, and a tube that establishes communication between the sound wave emission opening that is open to the outer space of the housing and the plurality of spaces. The sound quality can be adjusted in at least two different frequency ranges if at least one of the plurality of spaces has a volume different from those of other spaces.

Figure 12:
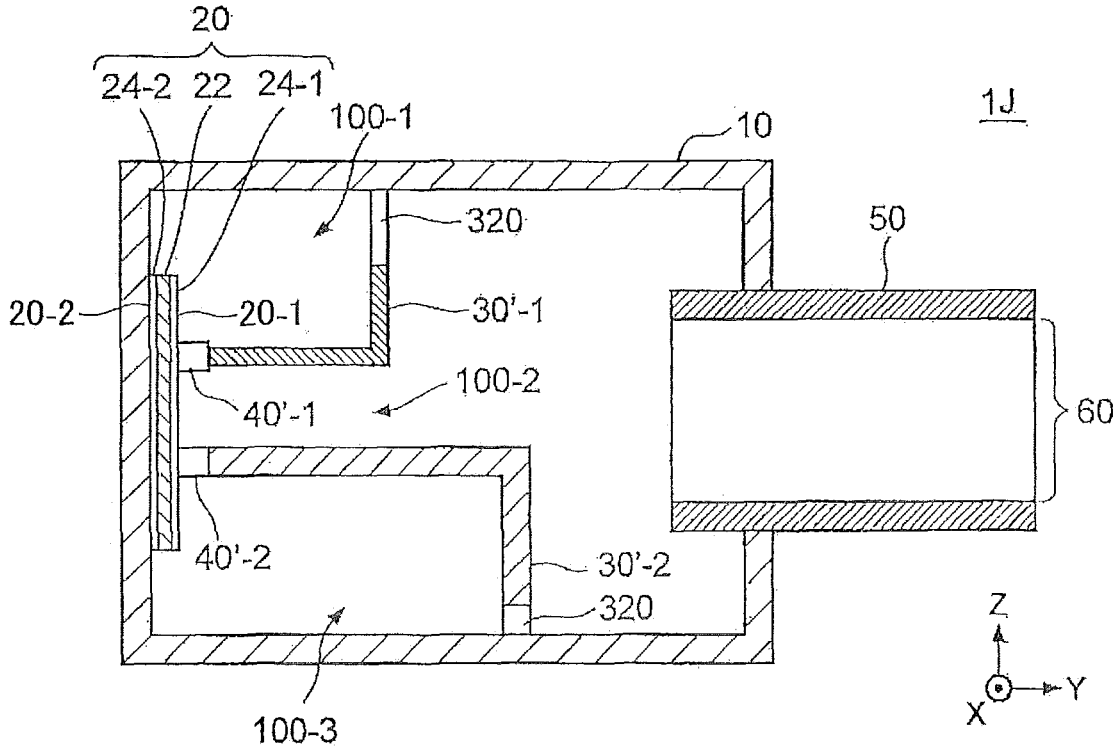
FIG. 12 is a cross-sectional view of an inventive earphone.

In an earphone 1J illustrated in FIG. 12, the space in the housing 10 is divided, by partition walls 30'4, 30'-2, into three spaces, i.e., the space 100-1, the space 100-2, and the space 100-3 having mutually different volumes. An elastic member 40'4 in FIG. 12 is a member filling a gap between the diaphragm 20 and one end of the partition wall 30'4 without inhibiting the vibration of the diaphragm 20 in the thickness direction. An elastic member 40'-2 is a member filling a gap between the diaphragm 20 and one end of the partition wall 30'-2 without inhibiting the vibration of the diaphragm 20 in the thickness direction. In the earphone 1J illustrated in FIG. 12, the sound quality can be adjusted in three different frequency ranges by dividing the inner space of the housing 10 into the three spaces having mutually different volumes.

Figure 13:
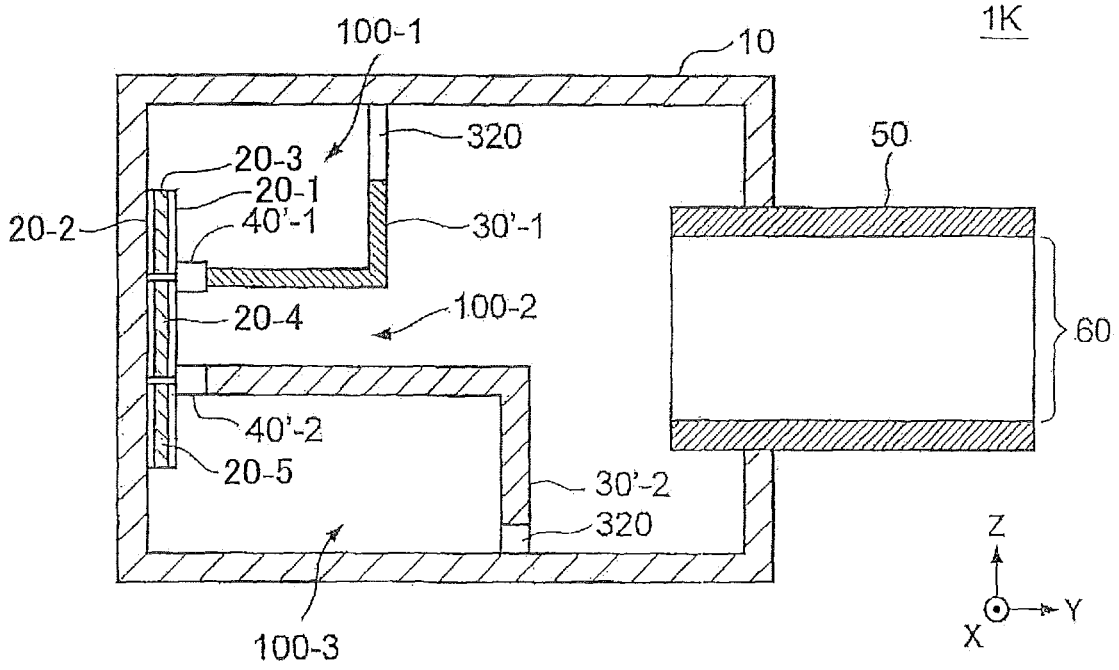
FIG. 13 is a cross-sectional view of an inventive earphone.

The diaphragm whose one surface faces the plurality of spaces is not limited to one diaphragm. That is, the earphone may include a plurality of diaphragms, as illustrated in FIG. 13. Specifically, an earphone 1K of FIG. 13 includes a diaphragm 20-3 as a diaphragm whose one surface faces the space 100-1, a diaphragm 20-4 as a diaphragm whose one surface faces the space 100-2, and a diaphragm 20-5 as a diaphragm whose one surface faces the space 100-3. In each of the diaphragm 20-3, the diaphragm 20-4, and the diaphragm 20-5, one of the two electrodes, which is provided on the other surface of the diaphragm attached to the inner wall surface of the housing 10, is grounded, and a voltage based on the sound signal is applied to the other of the two electrodes. In this configuration, the diaphragm 20-3, the diaphragm 20-4, and the diaphragm 20-5 respectively emit sound waves in the same phase. Similarly, in the earphones 1F-1I of FIGS. 8-11, the diaphragm facing the space 100-1 and the diaphragm facing the space 100-2 may be separate diaphragms.

(4) The earphones in the illustrated embodiments may be configured such that a ratio among the volumes of the plurality of spaces each serving as the cavity in the Helmholtz resonator and/or a ratio among the cross-sectional areas of the plurality of tubes each serving as the neck in the Helmholtz resonator may be variable. The thus configured earphone enables the user to finely adjust the sound quality in specific frequency ranges depending on the user's preferences or tastes.

Figure 14:
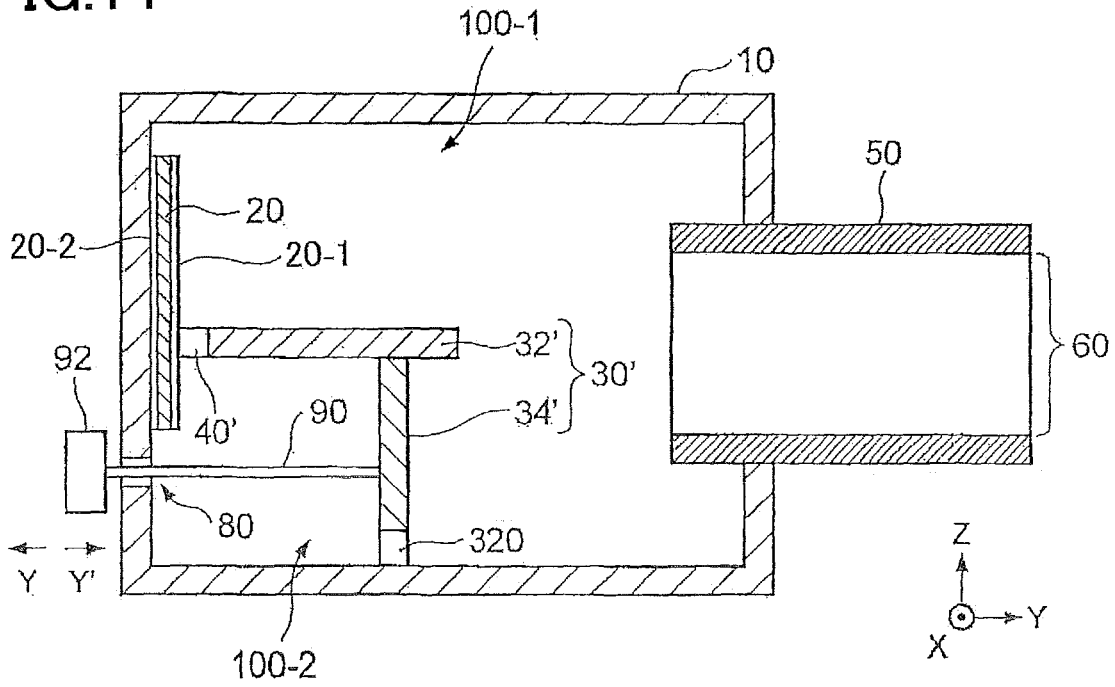
FIG. 14 is a cross-sectional view of an inventive earphone.

In the earphone 1A of the previous embodiment, for instance, by packing the sound absorber in one of the first tube 50-1 and the second tube 50-2 from an end portion of the tube 50 closer to the sound wave emission opening 60, the cross-sectional area of the one of the first tube 50-1 and the second tube 50-2 can be adjusted. For instance, the earphone 1F of the previous embodiment may be modified as illustrated in FIG. 14, such that the partition wall 30' is constituted by a plate-like first member 32' and a second member 34' provided so as to be perpendicular to the first member 32' and slidable in the Y direction in FIG. 14 and such that one end of a rod-like member 90 protruding outside the housing 10 through a through-hole 80 formed in the housing 10 is connected to the second member 34' and a knob 92 is attached to the other end of the rod-like member 90. In this configuration, the volume of the space 100-2 can be increased by pushing the knob 92 in a Y' direction or decreased by pulling the knob 92 in the Y direction. Likewise, in the earphone 1A of the previous embodiment, the volume of any one of the first space 110-1 and the second space 110-2 may be made variable.

What is claimed is:

1. An electroacoustic transducer, comprising:

a housing;

one or more partition walls that divide an inner space of the housing into a plurality of spaces including at least a first space and a second space such that a volume of a first of the plurality of spaces is different from a volume of a second of the plurality of spaces except the first of the plurality of spaces;

a diaphragm disposed in the housing such that a first surface that is opposite to a second surface of the diaphragm faces the first space and the second space of the plurality of spaces, the first surface of the diaphragm having a first region exposed to the first space and a second region different from the first region and exposed to the second space;

a tube that establishes communication between an outer space of the housing and at least one of the plurality of spaces; and an elastic member connecting the first surface and an end of the one or more partition walls, so as to fill a gap between the first surface and the end, wherein a cutout through which the first space and the second space are communicated with each other is formed in each of the one or more partition walls, and the first surface of the diaphragm is divided into the first region and the second region by a connected portion which is a portion of the diaphragm on the first surface and to which the elastic member is connected.

2. The electroacoustic transducer according to claim 1, wherein the second surface is fixed to an inner wall of the housing.

3. The electroacoustic transduce according to claim 1, wherein each of the one or more partition walls has an L-shaped cross section, and the elastic member is disposed between: an end in the L-shaped cross section of the one or more partition walls; and the first surface, so as to connect the end and the first surface.

4. The electroacoustic transducer, according to claim 3, wherein the elastic member is disposed between: a first end that is an end in the L-shaped cross section of the one or more partition walls; and the first surface of the diaphragm, so as to connect the first end and the first surface; and the cutout is formed at a second end that is an end in the L-shaped cross section of a corresponding one of the one or more partition walls.

5. The electroacoustic transducer according to claim 3, wherein the elastic member divides, as a part of one of the one or more partition walls, the inner space of the housing.

6. The electroacoustic transducer according to claim 1, wherein the first region is exposed to the first space without being exposed to the second space, and the second region is exposed to the second space without being exposed to the first space.

7. The electroacoustic transducer according to claim 1, further comprising: a sound absorber that is provided in a middle of at least one of propagation paths through each of which a sound propagates from a corresponding one of the plurality of spaces to the outer space.

8. The electroacoustic transducer according to claim 1, wherein the diaphragm is a piezoelectric element including a porous film and a pair of electrodes sandwiching the porous film therebetween.

9. The electroacoustic transducer according to claim 8, wherein the diaphragm is a plurality of diaphragms.

10. The electroacoustic transducer according to claim 1, wherein a volume ratio between the first space and the second space is variable.

11. The electroacoustic transducer according to claim 1, wherein the electroacoustic transducer is an earphone.

12. The electroacoustic transducer according to claim 1, wherein the one or more partition walls are disposed in the housing such that the first region of the first surface is equal to the second region of the first surface.

13. The electroacoustic transducer according to claim 1, wherein the one or more partition walls are disposed in the housing such that the first region of the first surface is larger than the second region of the first surface.

14. The electroacoustic transducer according to claim 1, wherein the diaphragm is a plurality of diaphragms including a first diaphragm and a second diaphragm, and the first diaphragm and the second diaphragm are configured to emit sound waves into the first space and the second space respectively.

15. The electroacoustic transducer according to claim 14, wherein the first diaphragm and the second diaphragm are spaced apart from each other.

* * * * *